United States Patent [19]

Jones et al.

[11] 4,014,685

[45] Mar. 29, 1977

[54] MANUFACTURE OF STEEL

[75] Inventors: Evan Thomas Richard Jones; Robert Anthony Fishburn, both of Birmingham, England

[73] Assignee: Foseco International Limited, Birmingham, England

[22] Filed: Nov. 14, 1974

[21] Appl. No.: 523,836

[30] Foreign Application Priority Data

Nov. 27, 1973 United Kingdom ..... 54996/73
Apr. 29, 1974 United Kingdom ..... 18712/74

[52] U.S. Cl. ..... 75/51; 75/53; 75/57; 75/58; 75/94

[51] Int. Cl.[2] ..... C21C 7/02; C22B 9/10

[58] Field of Search ..... 75/51–58, 75/94

[56] References Cited

UNITED STATES PATENTS

| | | | |
|---|---|---|---|
| 3,410,681 | 11/1968 | Orban | 75/53 |
| 3,467,167 | 9/1969 | Mahin | 75/53 |
| 3,537,842 | 11/1970 | Holland | 75/58 |
| 3,567,432 | 3/1971 | Wardell | 75/53 |
| 3,575,695 | 4/1971 | Miyashita | 75/51 |
| 3,681,050 | 8/1972 | Ueki | 75/58 |
| 3,695,946 | 10/1972 | Demeaux | 75/58 |
| 3,748,121 | 7/1973 | Atterbury | 75/53 |
| 3,799,762 | 3/1974 | Cass | 75/51 |
| 3,802,865 | 4/1974 | Ohkubo | 75/53 |

OTHER PUBLICATIONS

Latimer & Hildebrand, "Reference Book of Inorganic Chemistry", 3rd Ed., 1951, p. 327.

*Primary Examiner*—Peter D. Rosenberg
*Attorney, Agent, or Firm*—Cushman, Darby & Cushman

[57] ABSTRACT

The invention is concerned with the desulphurizing of molten steel by the use of a lime-based flux. In addition to lime the flux includes sodium carbonate, an alkali metal or alkaline earth metal fluoride, typically fluorspar, alumina and a metallic reducing agent. In particular, the reducing agent is aluminium or an alloy thereof and is present in an amount of 2 to 15% by weight. To desulphurize molten metal the flux is added to the molten metal in a vessel, typically by injecting the flux in particulate form into the molten metal.

12 Claims, No Drawings

MANUFACTURE OF STEEL

This invention relates to treating molten metals, particularly to desulphurising molten steel.

The need for low sulphur content steels is steadily increasing and steel standards are becoming increasingly stringent, particularly in respect of brittle fracture, welding and fabrication. The sulphur content of the steel can play an important and sometimes dominant role in determining these and other properties of the steel. The sulphur content also influences the as-cast and processing characteristics of the steel in terms of surface finish and tendency to cracking during rolling, since these affect the degree of scarfing or grinding required and the yield achieved in the finishing process.

The preferred method of desulphurising molten steel is to treat it with a metallurgical conditioning slag. The main factors promoting desulphurisation of the metal by the slag are well documented in the literature and can be summarised as (1) a high slag basicity, (2) low temperature, (3) reducing conditions and (4) high carbon, silicon and phosphorus in the metal. In addition, the rate of desulphurisation is increased by (1) high slag fluidity and (2) turbulence (to produce slag-metal reactions).

In one method of desulphurising steel, particularly when a low sulphur content steel is required, refining in the electric arc steelmaking process is finalised by providing a reducing slag over the entire surface of the molten metal. In this method, the initial oxidising slag is completely removed, the bath of metal is deoxidised and additions of lime, fluorspar and coke are added to form the reducing slag. However, this method of reducing the sulphur content in the final steel is slow and time-consuming.

We have now found that in a method of desulphurising molten steel in an arc furnace under reducing conditions which comprises injecting into the molten metal a stream of a particulate flux, fluxes comprising lime, sodium carbonate, fluorspar and alumina, and including a proportion of a metallic reducing agent, form, on contact with the molten metal, a highly basic slag which removes large quantities of sulphur from the molten metal. We have also found these fluxes to be useful when an injection technique is not employed.

Accordingly the present invention provides a flux composition for use in desulphurising molten steel, preferably in the method just described, which composition comprises lime, sodium carbonate, an alkali metal or alkaline earth metal fluoride or a mixture thereof, alumina, and a metallic reducing agent.

The invention also includes a method of desulphurising molten steel in an arc furnace under reducing conditions, which method comprises adding to the molten steel a flux composition in accordance with the invention.

Preferably, the fluoride is fluorspar and the invention is described below in terms of using this material. It is to be understood, however, that other alkali metal or alkaline earth metal fluorides may be used to replace fluorspar. For example, fluorspar may be wholly or partly replaced by sodium fluoride.

Preferably, the proportions of the ingredients in such a composition are in the following ranges (by weight):

| | | |
|---|---|---|
| lime | 50–80%, more preferably | 60–80% |
| sodium carbonate | 1–20%, more preferably | 1–15% |
| fluorspar | 5–30%, more preferably | 5–25% |
| alumina | 5–30%, more preferably | 5–25% |
| metallic reducing agent | 2–15% | |

The metallic reducing agent may be any easily oxidisable metal. Examples of such metals are aluminium, magnesium, ferrosilicon, calcium silicide, calcium, cerium, silicon; or alloys or mixtures of these metals. Of these aluminium or an aluminium alloy is preferred. Such a reducing agent may preferably constitute 2 to 10% by weight of the flux; under the conditions of use, the molten metal is rapidly deoxidised by the aluminium or other reducing agent and reducing conditions are promoted.

The oxidation of, for example, the aluminium is highly exothermic and this, together with the fluorspar and alumina of the composition, leads to the formation of a fluid mobile slag. The sodium carbonate also helps to form the fluid slag.

If desired, alumina and aluminium may be present together as ball mill dust in the composition.

One method of introducing the composition into the molten metal may be effected simply by using a carrier medium of compressed air. However, it is sometimes preferable to employ a non-oxidising gas such as nitrogen or argon (the latter being preferred because of a lack of side effects). A further method of enhancing the reducing effect of the composition is to inject the composition in a medium containing, or which may consist wholly of, a reducing gas such as propane, natural gas or the like. In the case that propane or natural gas is used it may be desirable, after injection, to flush dissolved hydrogen out of the metal by injecting argon.

The amount of composition used will vary with the type of steel in the furnace in question, its previous treatment, sulphur content and the desired final sulphur content. Typically, for an 80 tonne electric arc furnace, the composition could be injected in argon (at a dilution of e.g. 45 kg composition per cubic metre of argon) at an addition rate of 10 – 15 kg composition per tonne of metal to be treated.

It is found that, using the preferred method of the present invention to lower the sulphur content during refining in the arc furnace, less deoxidising agent than usual need be added to the steel to kill it in the arc furnace between the oxidising and reducing stages; the metallic reducing agent in the flux enhances the killing operation.

Furthermore, it is found that using the treatment according to the present invention, there is a reduction in the quantity of non-metallic inclusions in the finally cast metal, particularly in the number of silicate inclusions.

The following examples will serve to illustrate the invention.

EXAMPLE 1:

A $^{0.43}$/0.48% carbon, $^{1.1}$/1.45% manganese, $^{0.15}$0.30% silicon, $^{0.15}$/0.30 chromium grade steel was desulphurised by injection with a flux of composition

| | |
|---|---|
| CaO | 65% |
| $CaF_2$ | 10% |

-continued

| | |
|---|---|
| $Na_2CO_3$ | 5% |
| $Al_2O_3$ | 14% |
| Al | 6% |

| Sulphur Content % | | | | |
|---|---|---|---|---|
| Initial | After injection | At tap | Pit | Application Rate |
| 0.036 | 0.019 | 0.015 | 0.012 | 16.3 kgs/tonne |

The refining-to-tapping time was 2 hours. For comparison, the average refining-to-tapping time for this grade of steel, averaged over 11 casts, was 2 hours 40 minutes.

A typical result was:

| Sulphur Content, % | | |
|---|---|---|
| Initial | At tap | Pit |
| 0.028 | 0.020 | 0.016 |

EXAMPLE 2

| A 0.38/0.43% carbon steel treated with | |
|---|---|
| CaO | 65% |
| $CaF_2$ | 10% |
| $Na_2CO_3$ | 5% |
| ball mill dust | 20% (providing 14% $Al_2O_3$, 6% Al). |

| Initial | After injection | At tap | Pit | Application Rate |
|---|---|---|---|---|
| 0.029 | — | 0.012 | 0.010 | 16.3 kgs/tonne |

Refining-to-tap time was 2 hours 10 minutes, which compared favourably with an average time of 3 hours (average of 9 casts) when the method of the invention was not used.

EXAMPLE 3

Two casts of an 18/8 titanium stabilised steel were treated with the following composition:

| | |
|---|---|
| CaO | 65% |
| $Na_2CO_3$ | 5% |
| $CaF_2$ | 6% |
| $Al_2O_3$ | 20% |
| Al powder | 4% |

The results obtained were:

| Sulphur Content % | | |
|---|---|---|
| Initial | At Pit | Application Rate |
| 0.028 | 0.010 | 9 kgs/tonne |
| 0.020 | 0.008 | 15 kgs/tonne |

EXAMPLE 4

Two casts of carbon steel were treated with the following composition:

| | |
|---|---|
| CaO | 65% |
| $Na_2CO_3$ | 5% |
| $CaF_2$ | 8% |
| $Al_2O_3$ | 20% |
| Al | 2% |

| Sulphur Content % | | |
|---|---|---|
| Initial | At Pit | Application Rate |
| 0.010 | 0.006 | 10 kgs/tonne |
| 0.042 | 0.016 | 7 kgs/tonne |

EXAMPLE 5

A $^{0.43}$/0.48% carbon, $^{1.1}$/1.45% manganese, $^{0.15}$/0.30% silicon, $^{0.15}$/0.30% chromium grade steel was desulphurised by injection with a flux of composition

| | |
|---|---|
| CaO | 68% |
| $CaF_2$ | 6% |
| $Na_2CO_3$ | 5% |
| $Al_2O_3$ | 11% |
| Al powder | 10% |

| Sulphur Content, % | | | | |
|---|---|---|---|---|
| Initial | After injection | At tap | Pit | Application rate |
| 0.036 | 0.019 | 0.015 | 0.010 | 16.3 kgs/tonne |

The refining-to-tapping time was 2 hours. For comparison, the average refining-to-tapping time for this grade of steel, averaged over 12 casts, was 2 hours 50 minutes.

A typical result was:

| Sulphur content, % | | |
|---|---|---|
| Initial | At tap | Pit |
| 0.028 | 0.020 | 0.016 |

EXAMPLE 6

| A 0.38/0.43% carbon steel treated with | |
|---|---|
| CaO | 68% |
| $CaF_2$ | 10% |
| $Na_2CO_3$ | 5% |
| alumina ($Al_2O_3$) | 11% |
| aluminium (Al) | 6% |

| Initial | After injection | At tap | Pit | Application rate |
|---|---|---|---|---|
| 0.029 | — | 0.012 | 0.010 | 16.3 kgs/tonne |

Refining-to-tap time was 2 hours 15 minutes, which compared favourably with an average time of 3 hours (average of 9 casts) when the method of the invention was not used.

EXAMPLE 7

A low-carbon premelt quality stainless-steel (18/8) was desulphurised by injection with a flux having the following composition:

| | |
|---|---|
| CaO | 65% |
| $Na_2CO_3$ | 5% |
| $CaF_2$ | 6% |
| $Al_2O_3$ | 14% |
| Al powder | 10% |

| Cast | Initial S | After injection | At tap | Application rate |
|---|---|---|---|---|
| 1 | 0.120 | 0.080 | 0.060 | 15.0 kgs/tonne |
| 2 | 0.120 | 0.060 | 0.033 | 15.0 kgs/tonne |
| 3 | 0.090 | 0.070 | 0.032 | 15.0 kgs/tonne |

We claim as our invention:

1. A flux composition for use in desulphurising molten steel in a furnace, which composition comprises 50 to 80% by weight of lime, from 1–20% by weight of sodium carbonate, from 5–30% by weight of a fluoride selected from alkali metal and alkaline earth metal fluorides and mixtures thereof, 5–30% by weight of alumina and from 2–15% by weight of a metallic reducing agent.

2. A flux composition as claimed in claim 1, wherein the fluoride is fluorspar.

3. A flux composition as claimed in claim 2 which contains from 50 to 80% by weight of lime, from 1 to 15% by weight of sodium carbonate, from 5 to 25% by weight of fluorspar and from 5 to 25% by weight of alumina.

4. A flux composition as claimed in claim 1, which contains from 60 to 80% by weight of lime.

5. A flux composition as claimed in claim 1, wherein the metallic reducing agent is selected from aluminium and aluminium containing alloys.

6. A flux composition as claimed in claim 2 wherein fluorspar is wholly or partly replaced by sodium fluoride.

7. A method of desulphurising molten steel in an arc furnace under reducing conditions, which method comprises adding to molten steel a flux composition as claimed in claim 1.

8. A method as claimed in claim 7 wherein a stream of the flux composition in particulate form is injected into the molten steel.

9. A method as claimed in claim 7 wherein the composition in particulate form is injected into the molten steel in a medium selected from compressed air, nitrogen, argon and mixtures thereof.

10. A method as claimed in claim 7 wherein the flux composition in particulate form is injected into the molten metal in a medium containing a reducing gas.

11. A method as claimed in claim 7 wherein the composition in particulate form is injected into the molten metal in a medium containing a reducing gas selected from propane, and natural gas.

12. Desulphurised steel when manufactured by a method as claimed in claim 7.

* * * * *